US008727245B2

(12) United States Patent
Hogan

(10) Patent No.: US 8,727,245 B2
(45) Date of Patent: May 20, 2014

(54) PRESSURE WASHER WAND EDGER

(76) Inventor: Robert S Hogan, Dunedin, FL (US)

( * ) Notice: Subject to any disclaimer, the term of this patent is extended or adjusted under 35 U.S.C. 154(b) by 638 days.

(21) Appl. No.: 12/687,922

(22) Filed: Jan. 15, 2010

(65) Prior Publication Data

US 2011/0174903 A1 Jul. 21, 2011

(51) Int. Cl.

| | |
|---|---|
| ***B05B 3/00*** | (2006.01) |
| ***B05B 3/18*** | (2006.01) |
| ***A62C 31/24*** | (2006.01) |
| ***B05B 15/06*** | (2006.01) |

(52) U.S. Cl.
USPC ..... 239/754; 239/722; 239/280; 239/532

(58) Field of Classification Search
USPC ..... 239/750, 280, 282, 532, 754, 722; D32/15; D15/17; 404/107, 111, 93–94
See application file for complete search history.

(56) References Cited

U.S. PATENT DOCUMENTS

| | | | | | |
|---|---|---|---|---|---|
| 1,949,904 | A * | 3/1934 | Guedel | 239/280 |
| 4,545,531 | A * | 10/1985 | Williams | 239/150 |
| 4,877,348 | A * | 10/1989 | Opie | 404/93 |
| 4,914,899 | A * | 4/1990 | Carmine | 56/16.7 |
| 5,351,762 | A * | 10/1994 | Bean | 172/17 |
| 5,669,558 | A * | 9/1997 | Ichel | 239/311 |
| 6,776,363 | B1 * | 8/2004 | Falletta et al. | 239/722 |
| 6,929,198 | B2 * | 8/2005 | Dexter | 239/754 |
| 7,121,484 | B2 * | 10/2006 | Daley | 239/754 |
| 7,806,351 | B1 * | 10/2010 | Bakas | 239/754 |
| 2008/0217878 | A1 * | 9/2008 | Cephas | 280/47.35 |
| 2008/0251603 | A1 * | 10/2008 | Monty | 239/71 |

* cited by examiner

*Primary Examiner* — Len Tran
*Assistant Examiner* — Chee-Chong Lee
(74) *Attorney, Agent, or Firm* — Defillo & Associates, Inc.; Evelyn A. Defillo

(57) ABSTRACT

The present invention relates to an attachment for a pressure washer wand comprising: a plate having a front end, a rear end, top end, and a bottom end; a first wheel connected to the front end of the plate; a second wheel connected to the rear end of the plate; an angle bracket connected to the plate; a clamp connected to the angle bracket; and optionally a spray wand connected to the clamp. The design of the spray wand attachment of the present invention allows for cleaning a narrow area (only a few inches wide) from the edge of the hard surface. The edger of the present invention is not designed to clean the entire areas of the hard surface because the plate needs to be in contact with the edges of the hard surface, which prevents the device from moving away from the edges.

4 Claims, 4 Drawing Sheets

PRESSURE WASHER WAND EDGER

FIELD OF THE INVENTION

The present invention relates to an attachment for a spray wand, particularly to an attachment which can be used for cleaning the edges of a sidewalk, driveway, or other hard surface.

BACKGROUND OF THE INVENTION

Pressure washer devices have been used for many years. However, the pressure washer devices currently available are difficult to use while cleaning the edges of hard surfaces.

One of the most popular pressure washer tools known in the art is called SURFACE CLEANER®. A SURFACE CLEANER® looks like a lawn mower but with no engine on the top. The device has a bar underneath of the housing. The bar is mounted to the SURFACE CLEANER® at the center of the bar, this is where the high water pressure enters the bar causing the bar to spin very fast. There is a water jet at each end of the bar. This design enables the machine to clean hard surfaces much faster than a spray wand. The most common size SURFACE CLEANER® is 20 inches wide but it only cleans a path of about 18 inches wide.

Unfortunately, the SURFACE CLEANER® device has a disadvantage. When cleaning the hard surface, the surface cleaner does not clean all the way up to the edge of the hard surface because the surface cleaner is riding along the edge of the grass leaving an un-cleaned strip of an inch or more wide.

The user in the pressure washing industry commonly cleans this leftover dirty strip with a spray wand. Spray wands are held freehand while cleaning the edges, which makes the cleaning process a slow, tedious task due to the high water pressure glancing off the edge of the hard surface hitting the adjacent dirt and grass, creating a muddy mess or even flooding. In addition, the operator is cleaning the edges and walking at the same time, which can cause the operator to veer off the edge and hit the grass or dirt adjacent to the edge creating a greater muddy mess or even flooding. Furthermore, hitting the grass and dirt adjacent to the edge creates grooves on the lawn, damaging the lawn and creating an unpleasant view.

Accordingly, it is desirable to provide a pressure washer wand attachment capable of easily and swiftly cleaning the edges along sidewalks, driveways, or any other hard surface without virtually any muddy mess or flooding. In addition, it is desirable to provide a pressure washer wand attachment that prevents high pressure water from hitting the lawn or landscape adjacent to the edge of the surface to be cleaned.

SUMMARY OF THE INVENTION

It is one objective of the present invention to provide an attachment for a spray wand capable of easily cleaning the edges along sidewalks, driveways, pavement curbs, and other hard surfaces.

It is another objective of the invention to provide an edging guide for a spray wand.

It is another objective of the invention to convert a pressure washing wand into a pressure washing edger by attaching the device of the present invention to an existing pressure washer wand.

The spray wand edger of the present invention comprises a body adapted for mounting to any commercially available spray wand. The present invention will be explained in relation with a pressure washer wand, but the present invention should not be limited to pressure washer wands.

The present invention relates to an attachment for a spray wand comprising:

a plate having a front end, a rear end, top end, and a bottom end;

a first wheel connected to the front end of the plate;

a second wheel connected to the rear end of the plate;

an angle bracket connected to the plate;

a clamp connected to the angle bracket; and optionally a spray wand connected to the clamp.

The plate runs at least an eighth of an inch below the surface of the wheels. The plate has preferably a triangular shape.

In a preferable embodiment, the attachment comprises the spray wand having a hollow rod and a spray nozzle.

In another preferable embodiment, the rod has a 35 degree bend located five inches away from the spray nozzle.

In another preferable embodiment, the rod is between 40-52 inches long.

In another preferable embodiment, the angled bracket has preferably an L-shape.

In another preferable embodiment, the spray nozzle has a fixed 40 degree spray angle.

The foregoing has outlined some of the more pertinent objectives of the present invention. These objectives should be construed to be merely illustrative of some of the more pertinent features and applications of the invention. Many other beneficial results can be obtained by applying the disclosed invention in a different manner or modifying the invention within the scope of the disclosure. Accordingly, other objectives and a fuller understanding of the invention may be had by referring to the summary of the invention and the detailed description describing the preferred embodiment in addition to the scope of the invention defined by the claims taken in conjunction with the accompanying drawings.

BRIEF DESCRIPTION OF THE FIGURES

For a fuller understanding of the nature and objectives of the invention, reference should be made to the following detailed description, taken in connection with the accompanying drawings, in which.

DETAILED DESCRIPTION OF THE INVENTION

For purposes of this application, the term "hard surface" will be used to refer to any type of pavement, driveway, floor, deck, sidewalk, or any other surface having edges. The device of the present invention may be used in any application where the edges of the hard surface need to be cleaned.

The device according to the present invention provides a way to clean the edges (a few inches wide) of hard surfaces without virtually any muddy-flooded mess or damage to the adjacent landscaping. In addition, the present invention prevents flooding by allowing the user to move faster during the cleaning process; thus, less water is accumulated in the landscaping close to the edges of the hard surface. Furthermore, the device of the present invention cleans the edges 5 to 10 times faster than the spray wand of the prior art.

Figure 1:
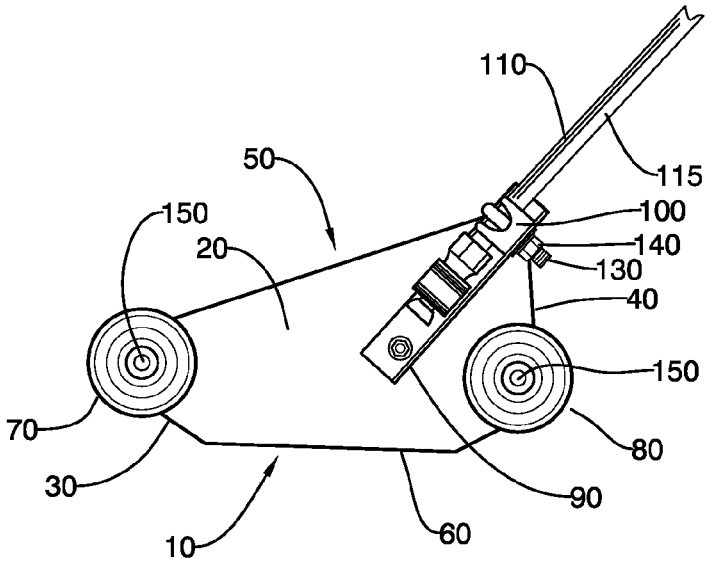
FIG. 1 illustrates a perspective front view of the pressure washer wand edger according to the present invention.
Figure 2:
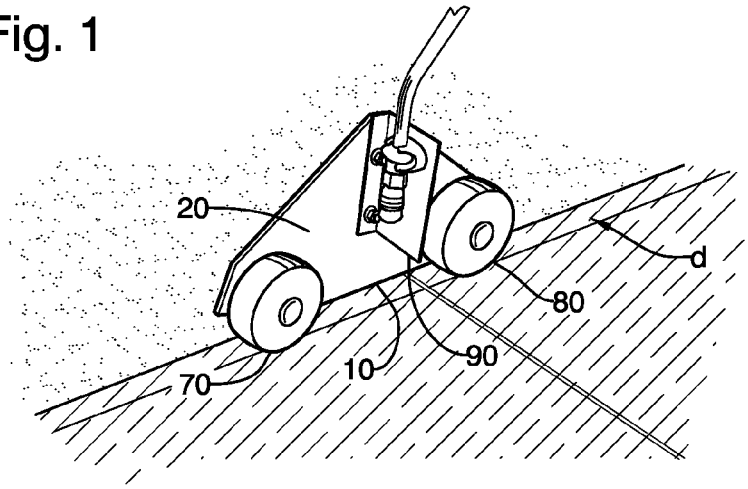
FIG. 2 illustrates a perspective side view of the pressure washer wand edger according to the present invention.
Figure 3:
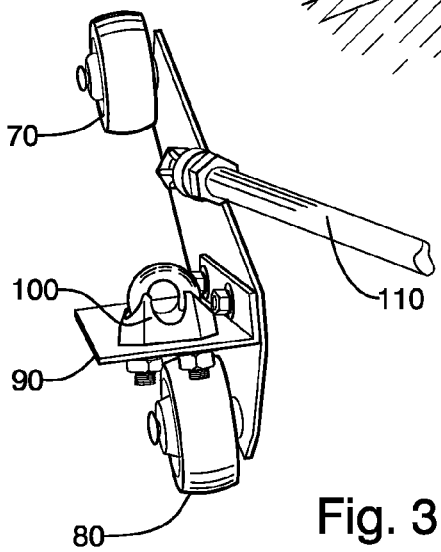
FIG. 3 illustrates a top view of the pressure washer wand edger according to the present invention.
Figure 4:
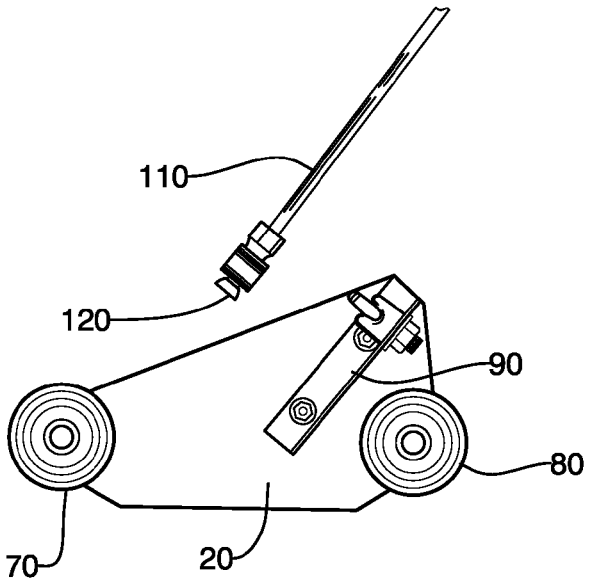
FIG. 4 illustrates a side view of the pressure washer wand edger according to the present invention having the wand removed from the wand edger.
Figure 5:
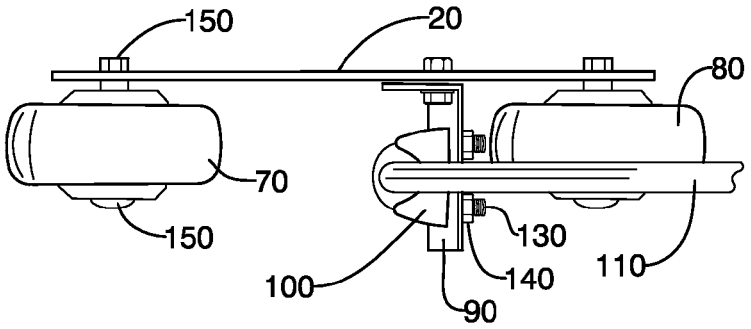
FIG. 5 illustrates a top view of the pressure washer wand edger according to the present invention having the wand attached to the edger.
Figure 6:
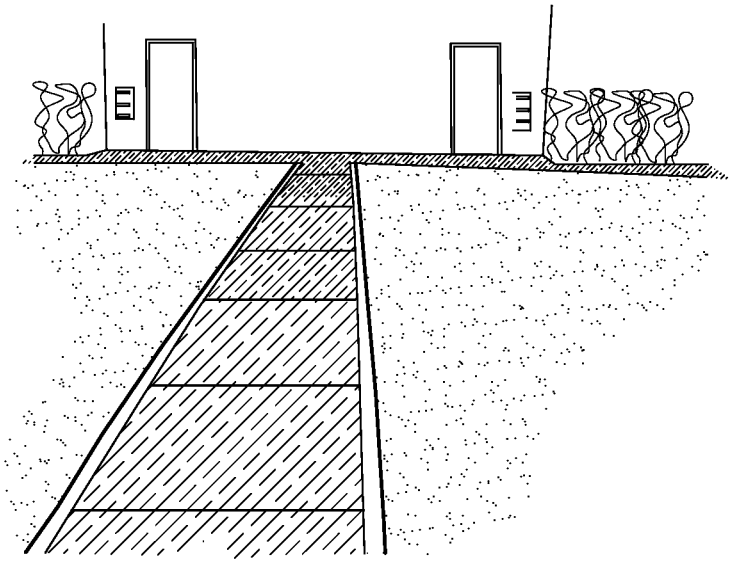
FIG. 6 illustrates a sidewalk after the edges were cleaned with the pressure washer wand edger according to the present invention.
Figure 7:
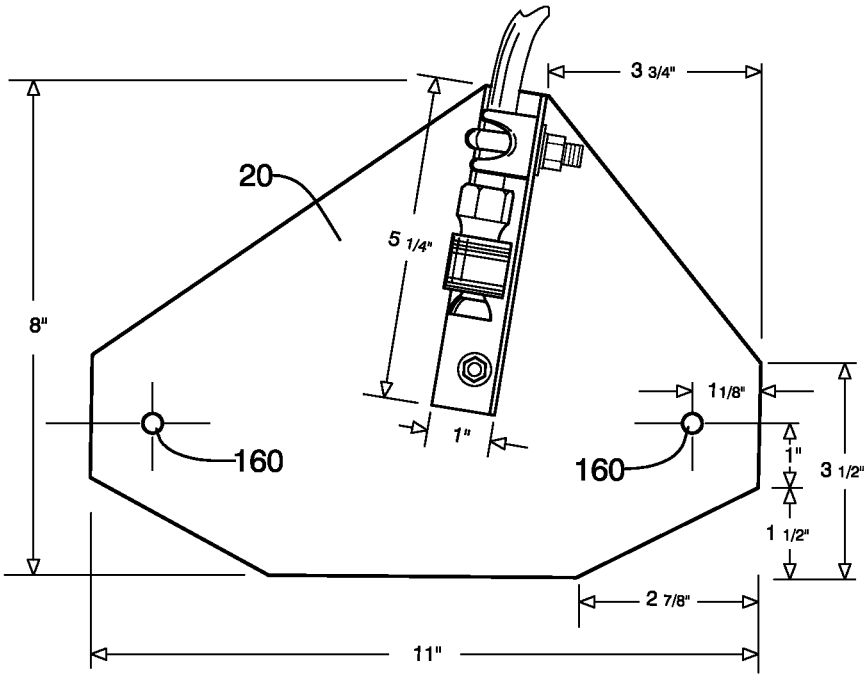
FIG. 7 illustrates a detailed view of the wand edger of the present invention.
Figure 8:
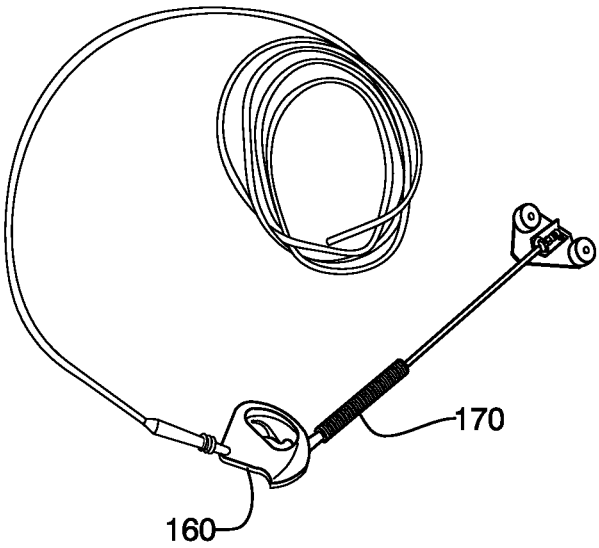
FIG. 8 illustrates a perspective view of the wand edger of the present invention being connected to a power washer device.
Figure 9:
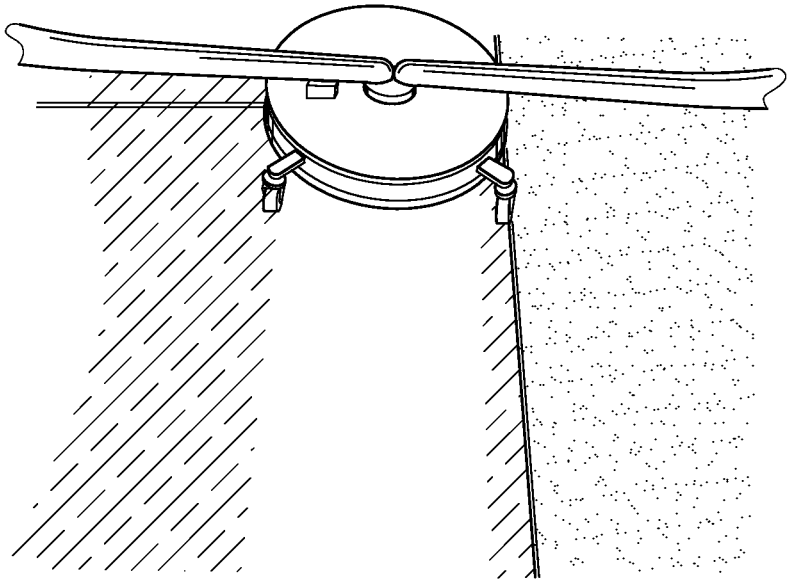
Fig. 9 PRIOR ART
FIG. 9 illustrates the device according to the prior art showing the dirt strip left behind by the device of the prior art when cleaning the edges of the surface.

FIG. 1 of the present invention shows a pressure washer wand edger comprising:

a plate 20 having a front end 30, a rear end 40, top end 50, and a bottom end 60;

a first wheel 70 connected to the front end 30 of the plate 20;

a second wheel 80 connected to the rear end 40 of the plate 20;

an angle bracket 90 connected to the plate 20;

a clamp 100 connected to the angle bracket 90; and optionally a spray wand 110 connected to the clamp 100.

The plate 20 extends downwardly from the body of the wand edger 10 and serves as a platform to mount the first wheel 70, the second wheel 80, and the angled bracket 90. The plate 20 runs at least a few inches, preferably an eighth of an inch, below the surface of the wheels 70, 80. Thus, the wheels 70, 80 support the wand edger 10 a sufficient distance above the hard surface and enables the wand edger 10 to be rolled along the edges of the hard surface in a straight path in cooperation with the plate 20. This allows the operator to maintain precise control of the pressure washer wand edger when the wand edger is in use.

The mechanical design of the present invention allows the plate 20 to function as a guide to limit both the width and height of the spray created by the spray nozzle while at the same time physically shields the high-pressure water spray from hitting the dirt and grass adjacent to the edge of the hard surface. In this way, the edges are cleaned quickly, easily, and consistently as the plate directs the water spray directly to the edges of the hard surface.

When using the wand edger 10 of the present invention, the plate 20 extends into a channel d formed between the lawn and the edges of the hard surface. The plate 20 engages the vertical side of the edges of the hard surface for guiding the wand edger 10 in a straight path while in use.

The plate 20 is attached to the lower end 120 of the wand 110 of the pressure washer via the combination of a clamp 100 and the angled bracket 90.

The plate 20 may have any shape such as square, rectangular, circular, triangular, etc. in a preferred embodiment; the plate 20 has a triangular shape, is approximately 8 inches tall, eleven inches long, and is made of 8 inch thick aluminum.

In one embodiment of the present invention the front end 30 and the back end 40 of the plate 20 are angled to allow the plate to smoothly slide through the channel d.

Those skilled in the art will appreciate that the plate 20 can be made from any suitable materials including, but not limited to, plastics, wood, metals, and alloys etc., or a combination thereof.

The bottom end 60 of the plate 20 is fixed approximately 0.125 to 3 inches, preferably ¼ of an inch lower than the bottom of the wheels; thus the wheels 70, 80, roll on top of the surface to be cleaned.

The wheels 70, 80 are mounted to the plate 20 for rolling the wand edger 10 along the edges of the hard surface. The wheels 70, 80 are supported on axle pins 150 which extend through aligned holes 160 formed in the plate 20. Any fastening means, such as nuts and washers 155 or other type of connector secure the wheels 70, 80 to the plate 20.

In a preferable embodiment, the wheels may have, but are not limited to, 4 inches diameter.

In another embodiment, the wheel axle may also be formed by a stud integrally formed with the plate 20 and projecting there from.

The wheels are fastened to the plate 20 in a fixed position to enable the plate 20 to drop down and ride along the edges of sidewalks, driveways, or whatever hard surfaces are being cleaned.

The angled bracket 90 and the clamp 100 are attached to the plate 20 by the use of any type of fastener known to those skilled in the art. Preferably the present invention uses bolts 130 and nuts 140.

In a preferred embodiment, the angled bracket 90 is approximately an eighth-inch thick by one inch by three inches aluminum angle stock approximately 5 inches long. This embodiment is not limiting the size of the angled bracket. A person skilled in the art will be able to choose the appropriate dimensions for the angle bracket based upon the desired use.

The angled bracket 90 is fastened to the plate 20 by any type of fastening means known in the art. In a preferable embodiment, the angled bracket is mounted by using bolts 130 and nuts 140.

The spray wand 110 comprises an elongated hollow rod 115 having a spray nozzle 120 in one of its ends. The spray wand 110 is attached to the wand edger 10 by means of a clamp 100 that joins the hollow rod 115 to the angled bracket 90 holding the spray nozzle 120 fixed in place.

In a preferred embodiment, the hollow rod 115 has a bend. In another preferred embodiment, the bend is approximately, but is not limited to, a 35 degree located five inches away from the spray nozzle 120. The present invention is not limited to a bend of 35 degree. A person skilled in the art would be able to choose the suitable angle for the bend.

The clamp 100 is made of any sturdy material and may be any suitable means that facilitates the connection and disconnection of the spray wand 110. Preferably, the clamp 100 is a U-Clamp. However, it is contemplated that other configurations for attaching the spray wand to the plate 20 may be implemented.

In one embodiment of the present invention, the spray wand 110 mounts to the wand edger by using a ½ inch wire rope clip.

The spray wand known by the prior art is usually 36 inches long. The wand of the present invention is approximately 40-52 inches long, preferably 44-48 inches long. This allows the user to ease the posture and have better control of the edger 10.

The spray wand 110 further comprises a trigger gun 160. Any type of trigger gun known in the art may be used. In one embodiment, the present invention uses a trigger gun having specifications of 8.0 GPM, 400 PSI, ⅜" FPT inlet, ¼" outlet, and 300 degree F. maximum temperature.

The spray nozzle 120 is used to release the pressurized water from the pressure washer machine. The spray nozzle 120 is adjustable, so the water can be released at different pressures and spray volumes.

In a preferred embodiment, the spray nozzle 120 of the present invention is a coupler having a fixed 40 degree spray angle, which allows a better cleaning for a 2 to 3 inch wide strip from the edge of the hard surface inwards.

The spray wand 110 has a quick coupler on each end; one coupler is for the high pressure hose and one is for the 40 degree spray tip.

The spray 110 wand may optionally include a gripping section 170 at its upper end in order to facilitate the grip by the user. The gripping section may be molded on or fastened to the wand.

In one embodiment, the spray wand 110 has a bend towards the end that is closer to where the u-bolt fastens. The bend at the end of the wand 110 allows the spray pressure to be directed perpendicular to the hard surface, which produces an optimal cleaning.

The wand edger 10 of the present invention is operatively connected to any commercial—or most residential pressure washer wands known in the art. The known pressure washer transfers power to the wand edger 10 of the present invention.

In one embodiment of the present invention the spray wand of a conventional pressure washer is directly connected to the angled bracket of the present invention.

In another embodiment of the present invention, the spray wand according to the present invention is connected to a conventional pressure washer.

The wand edger of the present invention is lightweight, yet very sturdy, to withstand the demands of repeated use. It is quickly and conveniently attached or detached from most residential or any commercial pressure washer wands known in the art.

The design of the spray wand edger of the present invention allows for cleaning a narrow area (only a few inches wide) from the edge of the hard surface inwards. The wand edger of the present invention is not designed to clean the entire areas of the sidewalks, driveways, etc. because the plate 20 needs to be in contact with the edges of the hard surface, which prevents the device from moving away from the edges.

It is apparent, in view of the teachings herein, that embodiments of the present invention are particularly useful for pressure washing the edges of a hard surface. It will be understood that embodiments of the invention can be useful for the application of any suitable fluid, whether water, paint, etc, that is sprayed onto the edges of a hard surface.

While the invention has been illustrated and described as embodiments of a spray wand edger, accordingly it is not limited to the details shown, since it will be understood that various omissions, modifications, substitutions and changes in the forms and details of the device illustrated and its operation can be made by those skilled in the art without departing in any way from the spirit of the present invention. The teachings of all of the references cited herein are incorporated by reference to the extent not inconsistent with the teachings herein

What is claimed is:

1. A pressure washer wand edger adapted to be used with a spray wand to clean an edge of a hard surface in contact with a lawn, the edge having a vertical side in contact with the lawn and a top side forming a right angle with the vertical side, the pressure washer wand edger comprising:

a flat plate adapted to be extended vertically from the hard surface, the flat plate having a front end, a rear end, a top end, a bottom end, a first side, and a second side, a first aligned hole formed at the front end of the flat plate, a second aligned hole formed at the rear end of the flat plate;

a first axle pin attached to the front end of the flat plate, the first axle pin extended through the first aligned hole;

a second axle pin attached to the rear end of the flat plate, the second axle pin extended through the second aligned hole;

a first wheel mounted on the first axle pin of the flat plate, the first wheel projecting perpendicularly from the first side of the flat plate;

a second wheel mounted on the second axle pin of the flat plate, the second wheel projecting perpendicularly from the first side of the flat plate;

an angled bracket having a short side secured between the front end and the rear end of the flat plate and a long side projecting perpendicularly from the flat plate, the angled bracket is secured to the flat plate by using fasteners;

a clamp connected to the angled bracket, the clamp is secured to the angled bracket by using fasteners; and the long side of the angled bracket is adapted to shield the second wheel from a fluid dispersed by a spray nozzle of the spray wand secured to the angled bracket, the clamp is adapted to secure the spray wand to the angled bracket;

a fluid is configured to be dispensed from the spray wand perpendicular to the top side of the edge;

the flat plate protrudes below a surface of the wheels;

the first wheel and the second wheel are spaced apart from the flat plate by a distance, the flat plate is adapted to engage the vertical side of the edge and slides through a channel formed between the lawn and the vertical side of the edge as the wheels roll on top of the hard surface during a working position;

the pressure washer wand edger is a component separate from the spray wand.

2. The pressure washer wand edger according to claim 1, wherein the front end and the rear end of the flat plate are angled.

3. A combination of a spray wand and a pressure washer wand edger to clean an edge of a hard surface in contact with a lawn, the edge having a vertical side in contact with the lawn and a top side forming a right angle with the vertical side, the combination of the spray wand and the pressure washer wand edger comprising:

a flat plate adapted to be extended vertically from the hard surface, the flat plate having a front end, a rear end, a top end, a bottom end, a first side, a second side, a first aligned hole formed at the front end of the flat plate, a second aligned hole formed at the rear end of the flat plate;

a first axle pin attached to the front end of the flat plate, the first axle pin extended through the first aligned hole;

a second axle pin attached to the rear end of the flat plate, the second axle pin extended through the second aligned hole;

a first wheel mounted on the first axle pin of the flat plate, the first wheel projecting perpendicularly from the first side of the flat plate;

a second wheel mounted on the second axle pin of the flat plate, the second wheel projecting perpendicularly from the first side of the flat plate;

an angled bracket having a short side secured between the front end and the rear end of the flat plate and a long side projecting perpendicularly from the flat plate, the angled bracket is secured to the flat plate by using fasteners;

a clamp connected to the angled bracket, the clamp is secured to the angled bracket by using fasteners; and the spray wand is secured to the angled bracket by the clamp, the spray wand includes a rod having a first end adapted to be connected to a power pressure device and a second end including a spray nozzle, the second end of the spray wand and the spray nozzle are secured to the angled bracket by the clamp, the long side of the angled bracket shields the second wheel from a fluid coming out of the spray nozzle;

the second end of the rod includes a bend near the spray nozzle;

the fluid is dispensed from the spray nozzle perpendicular to the top side of the edge;

the flat plate protrudes below a surface of the wheels;

the first wheel and the second wheel are spaced apart from the flat plate by a distance, the flat plate engages the vertical side of the edge and slides through a channel formed between the lawn and the vertical side of the edge as the wheels roll on top of the hard surface during a working position.

4. The combination according to claim 3, wherein the rod is between 40-52 inches long.

* * * * *